US006038905A

United States Patent [19]

Cherubini

[11] Patent Number: 6,038,905

[45] Date of Patent: Mar. 21, 2000

[54] DEVICE TO REMOVE WORKING ROLLS IN A FOUR-HIGH ROLLING STAND

[75] Inventor: Mario Cherubini, Milan, Italy

[73] Assignee: Danieli & C. Officine Meccaniche SPA, Buttrio, Italy

[21] Appl. No.: 09/293,999

[22] Filed: Apr. 19, 1999

[30] Foreign Application Priority Data

Apr. 17, 1998 [IT] Italy ..... UD98A0064

[51] Int. Cl.[7] ..... B21B 31/07; B21B 31/08

[52] U.S. Cl. ..... 72/239

[58] Field of Search ..... 72/237, 238, 239

[56] References Cited

U.S. PATENT DOCUMENTS

| | | | |
|---|---|---|---|
| 3,638,467 | 2/1972 | Fujino . | |
| 3,754,426 | 8/1973 | Adair | 72/238 |
| 3,866,455 | 2/1975 | Petros | 72/239 |
| 3,869,898 | 3/1975 | Quehen . | |
| 4,771,626 | 9/1988 | Ichida et al. | 72/239 |

FOREIGN PATENT DOCUMENTS

| | | |
|---|---|---|
| 2344166 | 3/1975 | Germany . |
| 2094684 | 9/1982 | United Kingdom . |

*Primary Examiner*—Rodney A. Butler
*Attorney, Agent, or Firm*—Antonelli, Terry, Stout & Kraus, LLP

[57] ABSTRACT

Device to remove working rolls in a four-high rolling stand includes an upper working roll (11*a*) and a lower working roll (11*b*), associated with respective supporting chocks (12*a*, 12*b*), and relative back-up rolls, upper (13*a*) and lower (13*b*), associated with respective supporting chocks (14*a*, 14*b*). At least the chocks (14*b*) of the lower back-up roll (13*b*) laterally and partly contain the chocks (12*b*) of the lower working roll (11*b*). A pair of sliding rails (15) are mounted on board the chocks (14*b*) of the lower back-up roll (13*b*) and are movable vertically with respect thereto, the rails (15) including a first lowered, or inactive position, and a second raised, or working position, associated with the chocks (12*b*) of the lower working roll (11*b*) the chocks (12*b*) are associated at the lower part with relative sliders (21) suitable to cooperate with the rails (15) located in the raised positions. Actuators (23) to lift the rails are arranged in cooperation with the lower plane of the rolling stand (10) and are contained inside the space of the chocks (14*b*) of the lower back-up roll (13*b*), the actuators (23) being connected to the relative rails (15) by respective extension rods (16) arranged on the axial extension of the actuators (23).

13 Claims, 3 Drawing Sheets

DEVICE TO REMOVE WORKING ROLLS IN A FOUR-HIGH ROLLING STAND

FIELD OF THE INVENTION

This invention concerns a device to remove working rolls in a four-high rolling stand, wherein the chocks of the back-up rolls contain the chocks of the working rolls.

To be more exact, the invention is applied in a four-high rolling stand to facilitate, accelerate and rationalise the operations to remove and return the rolling rolls every time the rolls need to be maintained, ground or replaced, without modifying the architecture of the rolling stand and without intervening on the back-up rolls

BACKGROUND OF THE INVENTION

The state of the art includes rolling rolls which include counter-opposed working rolls, respectively upper and lower, defining the rolling plane and mounted on relative chocks, arranged on one side and the other of the rolling stand.

In four-high rolling stands the working rolls cooperate with respective upper and lower back-up rolls, which are also mounted on relative chocks arranged on one side and the other of the rolling stand.

In four-high rolling stands, the state of the art includes an embodiment where the chocks of the back-up rolls laterally contain, at least partly, the chocks of the relative working rolls.

In the state of the art, it is known that the working rolls need to be removed periodically from the rolling stand in order to replace them or to grind the surface.

The operation to remove the working rolls normally comprises a procedure to release the chocks from the housing of the stand followed by the axial removal of the rolls from the rolling stand.

For a four-high rolling stand where the chocks of the back-up rolls contain the chocks of the working rolls, there are different systems to remove the rolls which, however, have shown themselves to be complex to operate and/or bulky and/or not economically viable.

Among these there is a system which provides to use movable rails suitable to move from a lowered position of no contact, outside the rolling stand, to a raised working position, inside the rolling stand, and vice versa.

These rails cooperate with a roll removal plane arranged outside the rolling stand.

In the working position the movable rails come into contact with the chocks of the lower working roll and raise them by a desired value so that the chocks can be axially removed, with the relative rolls, from the rolling stand.

On the lower face of the chocks of the lower working roll there are advantageously included sliding means suitable to cooperate with the movable rails.

During the removal step the lower working roll is temporally constrained to the upper working roll, for example by means of a temporary clamping of the respective chocks, so as to achieve a single block which makes it possible to remove both rolls in a single operation.

This solution, although it is widely appreciated because it allows the rolls to be removed without altering the configuration of the rolling stand, has some disadvantages.

A first disadvantage is that it is necessary to use assemblies to move and lift the rails, and also the relative supports, which are very strong so as to be able to support the highly cantilevered loads to which the moving and lifting assemblies are subjected during the lifting and removal of the chocks and rolls.

In fact, the lifting assemblies, consisting for example of jacks, screws, driven sliders etc., are located outside and on the side of the stand and are introduced inside the stand during the replacement step, with an axis at least partly oblique with respect to the vertical development of the stand.

Moreover, moving the rail at a direction which is oblique to that at which the rolls are removed entails high friction forces which cause premature wear and over-sizing.

A further disadvantage is the large amount of space occupied outside and at the side of the stand.

Furthermore, the arrangement and the structure of the lifting assemblies entail considerable difficulties in maintenance.

The state of the art also includes devices wherein the sliding rails are always arranged inside the space occupied by the chocks of the lower working roll.

DE-A-2.344.166 discloses a device to lift the working rolls of a four-high rolling stand, the device comprising a pair of levers (19) for each of the rails, suitable to be made to rotate by outer actuators (14) arranged at the sides of the stand.

The actuators (14) are inclined with respect to the plane on which the rolls to be lifted lie.

This embodiment has the disadvantage that the mechanical parts are subjected to considerable stress due to the fact that the lifting devices do not act in line with the loads to be lifted and supported.

Moreover, it requires complex operations on the chocks in order to install the device. Furthermore, the system must necessarily conform to the diameters of the working rolls and the back-up rolls.

In GB-A-2.094.684, the system to lift the rails used to remove the working rolls comprises actuators (11) installed on board the chocks of the back-up rolls.

The system is very complex, since in order to lift the rails the actuators lift the chock of the lower back-up roll and at the same time determine the action of an L-shaped lever on a protrusion solid with the rails.

Moreover, the system requires special work to be installed and is expensive since every chock has its own actuators.

Furthermore, since it is installed on board the chocks, the system has to conform to the diameters of the working and back-up rolls.

U.S. Pat. No. 3,638,467 describes a removal system for working rolls wherein stationary rods (14, 16) are used, with the function of distancing, automatically and constantly, the chocks of the working and back-up rolls.

This document does not explain how the rails are lifted.

In any case, this document does not provide actuators inside the bulk of the rolling stand and suitable to lift the rails from their low position, as shown in FIG. 4, to the high position shown in FIG. 3 wherein they cooperate with the chocks of the lower working roll.

The present Applicant has designed, tested and embodied this invention to overcome these shortcomings and to obtain further advantages.

SUMMARY OF THE INVENTION

The purpose of the invention is to achieve a device to remove the rolls for a four-high rolling stand, where the chocks of the back-up rolls laterally contain, at least partly, the chocks of the working rolls, which will be economical, functional and above all which will have little impact on existing parts.

To be more exact, it reduces the work performed on the chocks of the lower back-up roll to house the rails and relative moving and guide assemblies.

Other purposes of the invention are: to simplify the structure of the mechanical assemblies used to remove the rolls and to reduce the bulk, the wear and the power employed, and also to reduce the mechanical stresses on the lifting and moving assemblies.

Moreover, the device according to the invention does not require any adaptation when the diameter of the working and back-up rolls varies.

All this is to simplify and accelerate the operations to remove/insert the working rolls from/into the rolling stand.

The invention provides to use guides and/or sliding rails associated in a vertically movable manner to the chocks of the lower back-up roll and arranged inside the bulk thereof.

The sliding guides or rails are suitable to be displaced vertically from a first inactive lowered position assumed during the normal working of the rolling rolls, to a second, raised active or working position assumed when the rolls are removed and/or replaced.

The means which actuate the lifting and consequent lowering of the guides or rails consist of actuators, advantageously one pair for each of the rails, arranged in cooperation with the lower plane of the rolling stand.

The lifting means are also contained inside the space occupied by the chocks of the lower working roll.

The device according to the invention therefore does not take up space at the side of the window of the rolling stand inasmuch as the guides, the actuators and the sliding rails are contained, in all the working steps, within the normal spaces of the stand.

Moreover, the device can be installed without altering the configuration of the stand.

According to one characteristic of the invention, the actuators are connected to the sliding rails by means of extension rods arranged as an axial extension of the actuators and associated by their upper end with the rails.

With the device according to the invention, the rails are lifted directly, by vertically activating the actuators and the relative drive rods with a direction orthogonal to the plane on which the loads to be supported and moved lie.

Therefore, the stresses on the lifting elements have only a vertical compression component substantially aligned with the reaction force exerted by the actuators themselves, without creating oblique or inclined load components.

The lifting system is driven, when necessary, to temporally take the rails located on the chocks of the lower back-up roll to a pre-determined height; the rails are taken, during the removal step, to support the chocks of the lower working roll and lift them.

According to the invention, the chocks of the lower working roll include at the lower part slider means solid with the chocks themselves, which allow the rolls to slide on the rails located on the chocks of the lower back-up roll, arranged in the raised removal position, and to pass from these rails to the plane on which the rolls are changed, which is located outside the rolling stand.

In this position wherein the rails located on the chocks of the lower back-up roll are raised, the single block of the working rolls is removed, while it is temporally constrained to make a single body, the direction of movement being substantially orthogonal to the direction of lifting of the sliding rails.

According to another characteristic of the invention, on the opposite inner faces of the chocks of the lower back-up roll there are facing sliding guides cooperating with the ends of the rails.

The sliding guides are suitable to facilitate the lifting/lowering vertical movements of the rails, guiding them constantly and contrasting the turnover torque.

BRIEF DESCRIPTION OF THE DRAWINGS

The attached Figures are given as a non-restrictive example and show a preferential embodiment of the invention wherein.

DETAILED DESCRIPTION OF PREFERRED EMBODIMENTS

The four-high rolling stand 10 shown in the attached Figures has an upper working roll 11*a* and a lower working roll 11*b* associated at their ends to respective supporting chocks 12*a* and 12*b*.

Each working roll 11*a*, 11*b* cooperates with a respective back-up roll, upper roll 13*a* and lower roll 13*b*, the function of which is to contrast the flections of the working rolls 11*a*, 11*b* caused by the rolling forces.

The back-up rolls 13*a*, 13*b* are supported at their ends by respective chocks 14*a* and 14*b*.

The chocks 14*a* and 14*b* of the back-up rolls 13*a* and 13*b* laterally contain, partly, the chocks 12*a* and 12*b* of the relative working rolls 11*a* and 11*b*.

On the lower faces of the chocks 12*b* of the lower working roll 11*b* sliders 21, respectively 21*a* and 21*b* are mounted, which allow the chocks 12*b* to slide and be axially removed during the step when the working rolls 11*a* and 11*b* are removed.

The sliders 21, which extend longitudinally opposite each other from one side of the rolling stand 10 to the other, may include rotary elements, pads or other means known to the state of the art, which is irrelevant for the purposes of the invention.

The sliders 21 are solidly constrained to the chocks 12*b* by means of respective attachment means 22.

In cooperation with the chocks 14*b* of the lower back-up roll 13*b* there is a pair of opposite sliding rails 15, respectively 15*a* and 15*b*, arranged longitudinally aligned with an axis substantially parallel to the axis of the working and back-up rolls.

Figure 1:
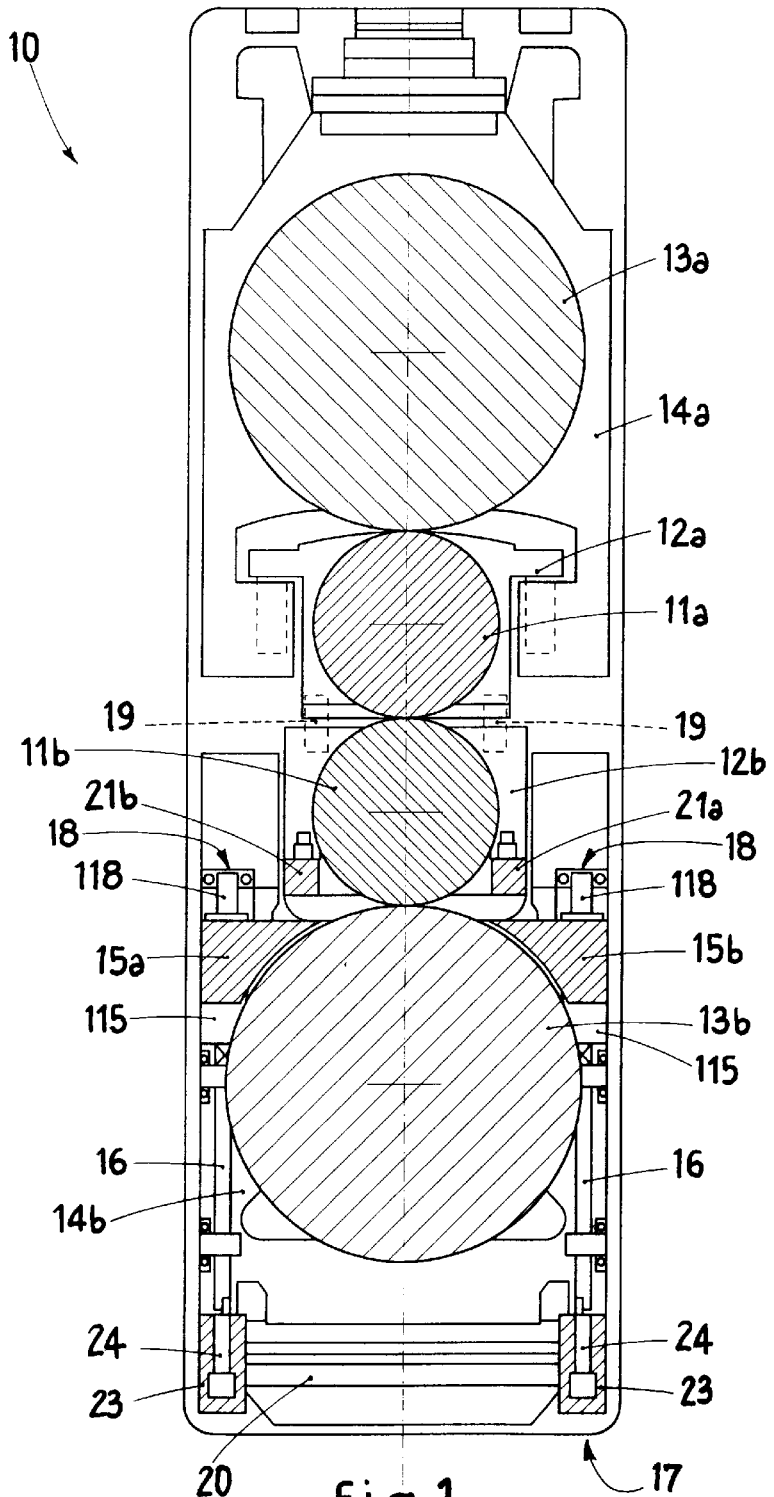
FIG. 1 shows partly in section the front of a four-high rolling stand using the device to remove rolls according to the invention.
Figure 2:
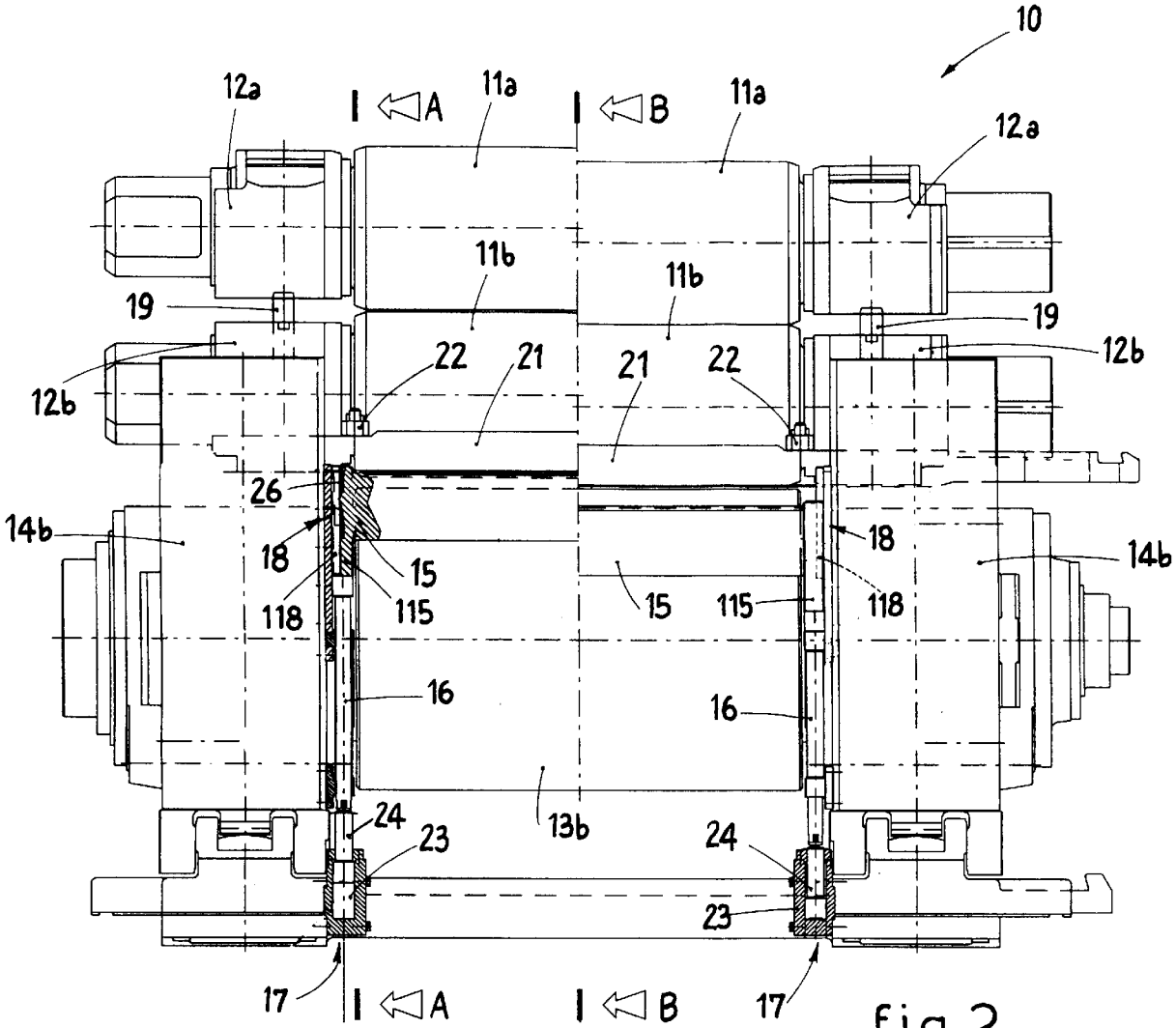
FIG. 2 is a part and side view of the rolling stand shown in FIG. 1, wherein the right side is shown with the removal device in its lowered, inactive position and the left side is shown in its raised position for the removal of the rolls.
Figure 3B:
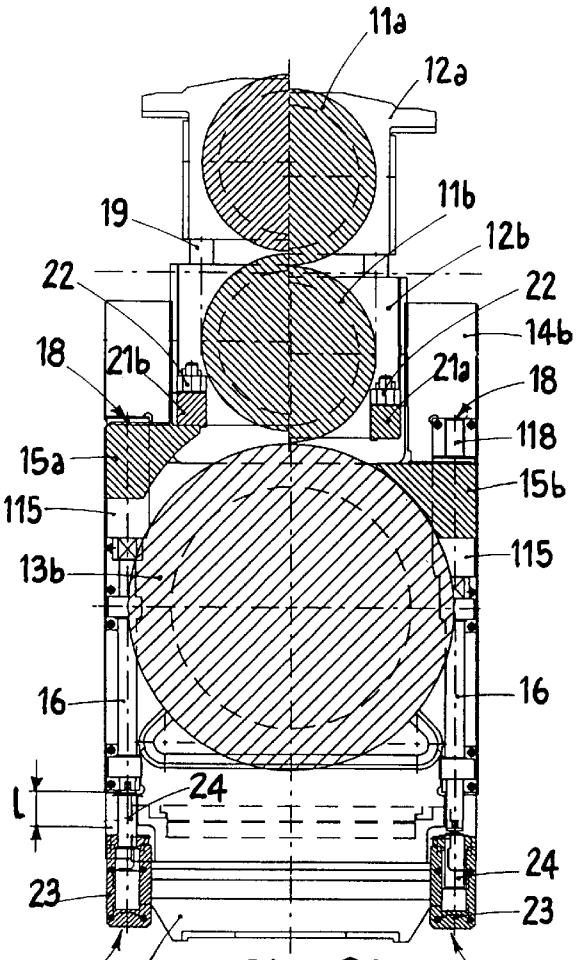
FIGS. 3*a* and 3*b* show respectively the section from A to A and the section from B to B of FIG. 2.
Figure 3A:
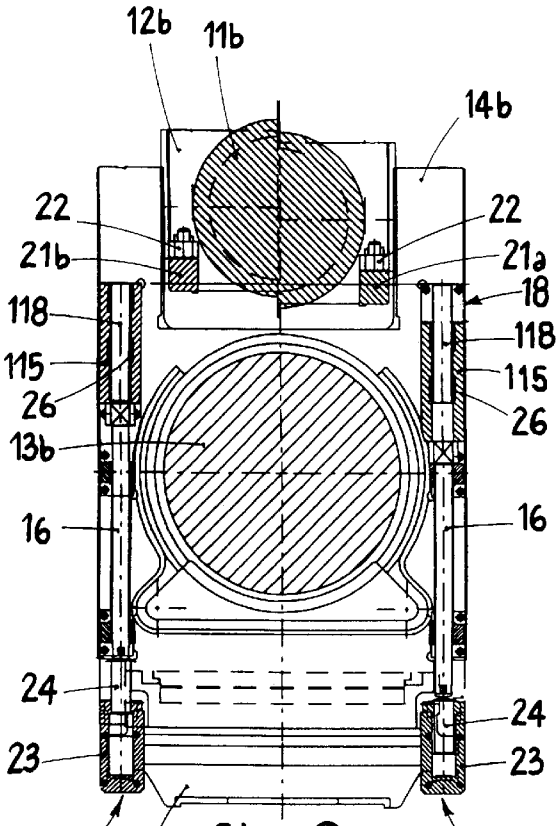

The sliding rails 15 are housed inside the space defined by the chocks 14*b* and are suitable to be moved vertically from a lowered inactive position (on the right in FIGS. 2 and 3*b*) to a raised working position (on the left in FIGS. 2 and 3*b*)

wherein they substantially come into contact with the relative sliders 21 to cooperate therewith during the removal step of the working rolls 11*a* and 11*b*.

To be more exact, when the stand 10 is in its position of normal use, that is to say, during the rolling steps, the sliding rails 15 are in a low position and not in contact with the sliders 21 solid with the chocks 12*b* of the lower working roll 11*b*.

During the step when the working rolls 11*a*, 11*b* are removed, the chocks 14*b* maintain their position unchanged while the rails 15 are raised, according to an axis which is substantially vertical and therefore orthogonal to the axis of the rolls.

According to the invention, the means to lift the rails 15 from the lowered position to the raised position consist of a lifting system 17 comprising actuators 23 arranged with their vertical axis substantially in cooperation with the base plane of the rolling stand 10.

To be more exact, in this case there are two actuators 23 for each rail 15, arranged substantially in cooperation with the ends of the rails 15, to a total of four actuators 23 arranged substantially at the four corners of the window of the rolling stand 10.

The actuators 23 are arranged in the lateral space defined by the chocks 14*b* of the lower back-up roll 13*b* and inside the said chocks 14*b*.

The actuators 23 are associated, with the respective rods 24, to extension rods 16, arranged aligned with the axis of drive of the actuators 23, the ends of which are constrained and act with a vertical push/pull movement on the rails 15.

The extension rods 16 are arranged along the inner face of the chocks 14*b* and are contained, in every step, within the space of the rolling stand 10.

To be more exact, the extension rods 16 extend vertically into the space between the chocks 14*b* and the ends of the relative lower back-up roll 13*b* (FIG. 2).

The lifting system 17 may be anchored, for example, on the stationary parts of the lower housing of the rolling stand 10.

According to a variant, the lifting system 17 is assembled on a slider 20, arranged below the chocks 14*b* supporting the lower back-up roll 13*b* and included to change the back-up roll 13*b*.

When the extension rods 16 are raised, through a travel of "l" (FIG. 3*b*), by the lifting system 17, the sliding rails 15 are taken into contact with the sliders 21 associated with the chocks 12*b* of the lower working roll 11*b*. This happens irrespective of the position of the lower back-up roll 13*b*.

According to the invention, on the inner faces of the chocks 14*b* of the lower back-up roll 13*b* there are guides 18 developed vertically which facilitate the sliding of the rails 15 from the lowered, inactive position to the raised working position and vice versa.

The guides 18, associated with the inner face of the chocks 14*b* of the back-up roll 13*b*, which extend for the whole height of the rails 15 and for the whole travel thereof from the lowered and raised positions, vertically guide the rails 15 and contrast the turnover torque.

Figure 4:
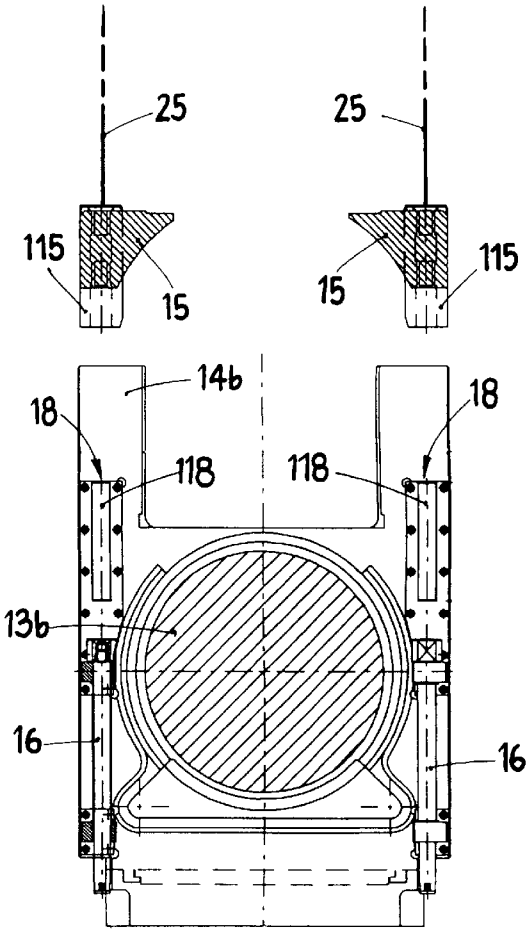
FIG. 4 shows in diagram form the rolling stand shown in FIG. 1 with the working rolls removed and the rails raised in the discharge position.

The guides 18, in this case, have a T shaped section with a protruding guide element 118 facing towards the inside of the chocks 14*b*, and cooperate with lateral U-shaped ends with the wings 115 facing towards the outside of the rails 15 (FIG. 4).

The wings 115 have wear-resistant sliding pads 26 to facilitate the vertical movement with respect to the guide elements 118.

The guides 18 also facilitate the complete removal of the rails 15, once the working rolls 11*a* and 11*b* have been completely removed, by means of a removal assembly equipped with lifting cables 25, for example a crane, a bridge crane or similar.

When the rails 15 are in the raised position, the working rolls 11*a* and 11*b* can be removed by running them along the rails 15; the loads and the mechanical stresses imparted to the lifting system 17 are substantially reduced thanks to the activation in a vertical direction of the extension rods 16 which support the rails 15, which extend in a direction aligned with the reaction forces exerted by the respective actuators 23.

The spaces occupied by the whole removal device, comprising the rails 15, the actuators 23 and the rods 16, at the side of the rolling stand 10 are also eliminated.

Moreover, by moving the rails 15 on an axis substantially orthogonal to the direction of movement of the rolls 11*a* and 11*b* which are to be removed, the forces of friction generated during the movement are minimised, thus reducing wear, and therefore entails less maintenance.

The rolls 11*a* and 11*b* are made temporally solid, so as to allow them to be removed in a single body, by activating the constraining means 19.

The constraining means 19 consist of protruding pins on the chocks 12*b* of the lower working roll 11*b* and suitable to be inserted into mating apertures on the chocks 12*a* of the upper working roll 11*a*.

What is claimed is:

1. Device to remove working rolls in a four-high rolling stand comprising upper working roll and lower working roll, associated with respective supporting chocks, and relative back-up rolls, upper and lower, associated with respective supporting chocks, wherein at least the chocks of the lower back-up roll laterally and partly contain the chocks of the lower working roll, the device comprising a pair of sliding rails mounted on board the chocks of the lower back-up roll and movable vertically with respect thereto, the rails including a first lowered, or inactive position, and a second raised, or working position, associated with the chocks of the lower working roll, the chocks being associated at a lower part with sliding means suitable to cooperate with the rails located in the raised position, the device further comprising actuators to lift the rails arranged in cooperation with the lower plane of the rolling stand and contained inside a space of the chocks of the lower back-up roll, the actuators being connected to respective rails by respective extension rods arranged on an axial extension of the actuators.

2. Device as in claim 1, characterised in that the extension rods extend vertically into a space between the chocks and the ends of the lower back-up roll.

3. Device as in any claim hereinbefore, characterised in that the sliding rails cooperate with guides made on opposite sides of inner faces of the chocks of the lower back-up roll.

4. Device as in claim 1, characterised in that the device comprises four actuators with relative extension rods, cooperating in twos with each rail and arranged substantially at four corners of the window of the rolling stand.

5. Device as in claim 1, characterised in that the chocks of the lower back-up roll are associated with a slider included to change the back-up roll.

6. Device as in claim 1, characterised in that the device comprises means suitable to temporally constrain the chocks of the lower back-up roll to the chocks (12*a*) of the upper working roll (11*a*) during the step when the working rolls are removed.

7. Device as in claim 1, characterised in that the rails are removable from the rolling stand from above, after the working rolls have been removed.

8. Device as in claim 2, characterised in that the extension rods include a vertical movement in a direction substantially orthogonal to the direction of movement of the rolls during removal.

9. Device as in claim 3, characterised in that the guides are substantially T-shaped with a protruding guide element facing towards the inside of the chocks and suitable to cooperate with substantially U-shaped wings made on the lateral sides of the rails.

10. Device as in claim 9, characterised in that the protruding guide element extends for a whole height and for a whole travel "l" of the rails from the first lowered position to the second raised position.

11. Device as in claim 9, characterised in that the wings include wear-resistant sliding pads cooperating with the guide elements.

12. Device as in claim 4, characterised in that a lower part of each of the actuators is anchored to lower stationary housings of the rolling stand.

13. Device as in claim 5, characterised in that a lower part of each of the actuators is anchored to the slider.

* * * * *